US007118095B1

(12) United States Patent
Stidham et al.

(10) Patent No.: US 7,118,095 B1
(45) Date of Patent: Oct. 10, 2006

(54) LIFTING REEL MOUNTED ON A TREE STAND

(76) Inventors: Oren W. Stidham, 3356 Highway 157, Falkville, AL (US) 35622; Patricia A. Stidham, 3356 Highway 157, Falkville, AL (US) 35622

( * ) Notice: Subject to any disclaimer, the term of this patent is extended or adjusted under 35 U.S.C. 154(b) by 242 days.

(21) Appl. No.: 10/884,934

(22) Filed: Jul. 6, 2004

Related U.S. Application Data

(60) Provisional application No. 60/484,901, filed on Jul. 7, 2003.

(51) Int. Cl.
*B66D 5/02* (2006.01)

(52) U.S. Cl. ..... 254/375; 254/380

(58) Field of Classification Search ..... 254/266, 254/329, 375, 380; 182/20, 129, 116, 168
See application file for complete search history.

(56) References Cited

U.S. PATENT DOCUMENTS 4,132,389 A * 1/1979 Panzarella ..... 254/375
4,593,789 A * 6/1986 Treants ..... 182/142
4,597,562 A * 7/1986 Joyce ..... 254/334
4,603,839 A * 8/1986 Ekman et al. ..... 254/329
5,009,283 A * 4/1991 Prejean ..... 182/116
5,603,489 A * 2/1997 Regal ..... 254/378
5,607,143 A * 3/1997 Regal ..... 254/342
5,620,193 A * 4/1997 Dschaak ..... 280/47.31
5,816,564 A * 10/1998 Winter ..... 254/266
5,975,499 A * 11/1999 Ostrobrod ..... 254/332
6,186,271 B1 * 2/2001 Borries et al. ..... 182/20
6,769,669 B1 * 8/2004 Cook et al. ..... 254/329
7,021,606 B1 * 4/2006 Raycraft ..... 254/329

* cited by examiner

*Primary Examiner*—Emmanuel M Marcelo
(74) *Attorney, Agent, or Firm*—Joe Beumer

(57) ABSTRACT

A device is provided for lifting and lowering objects to and from a deployed tree stand by an occupant of the tree stand. The device has a clamp connectable to a rigid support member of the stand, a threaded shaft connected to the clamp, a reel mounted on the shaft, and a threaded knob also mounted on the shaft, the knob having an inner portion with a contacting surface which comes into contact with a mating contact surface of the reel upon turning of the knob by the occupant. Upon making contact, the reel is slowed down and may be stopped by braking action. This enables control over movement, which may be stopped and restarted, as well as slowed down at any location.

7 Claims, 1 Drawing Sheet

LIFTING REEL MOUNTED ON A TREE STAND

CROSS REFERENCE TO RELATED APPLICATION

This application claims the benefit of Provisional Application Ser. No. 60/484,901, filed Jul. 7, 2003.

FIELD OF THE INVENTION

This invention relates to tree stands used by hunters and more particularly to devices for lifting objects from the ground to a tree stand and lowering them back down by a tree stand occupant.

BACKGROUND OF THE INVENTION

Hunters who have climbed up and become situated in a tree stand have a need for a means of lifting various objects upward for use or consumption in the tree stand, in particular hunting rifles, ammunition and various other useful items. A similar need arises for lowering objects back to the ground. The most commonly used approach for lifting up of objects to the level of a tree stand is to tie the object to one end of a pull rope and pull the rope upward until the object comes within the grasp of the occupant. This approach has disadvantages is that the rope tends to become tangled as it accumulates at the tree stand level, and stopping movement of the pulled object requires tying knots is the rope and removing them afterwards. Another problem that arises is that the pull rope is not permanently connected to the tree stand and may be forgotten or lost when needed. It would be desirable to provide a lifting system in which a pulling rope or cord is automatically kept under control of the user and which includes a braking feature allowing the load to held at any location and easily released.

SUMMARY OF THE INVENTION

The present invention is directed to a tree stand lifting devise comprising a clamp attachable to a a rigid structural member of the tree stand within reach of the occupant, a shaft fixedly connected to the clamp, a reel rotatably mounted on the shaft, an outer surface of the reel having a contacting portion adjacent to the shaft and a knob mounted at an end of the shaft, the knob including an internal contacting area engageable with the contacting portion of the reel and the knob having defined therein a central orifice threadably engaging an outer end of the shaft. The reel also has a cranking handle disposed on an outer side near the periphery.

Manually turning the knob until the contacting areas are firmly engaged provides braking action, and movement of the lifted load is stopped. A less firm engagement may be used to control the rate of movement, especially when objects are being lowered. The handle and the knob are located such that both of these components may be operated with only one hand.

The reel may be configured such that it neatly contains an ample amount of cord or rope, preventing tangling or interference with activities of the user. Connection of the clamp to the tree stand may be treated as permanent, which condition would avoid loss of or forgetting to bring a pull rope to the site of use.

It is therefore an object of this invention to provide a device for lifting items of equipment for placement on a tree stand.

Another object is to provide such a device wherein lifting ropes or cords are kept under control of the user.

Yet another object is to provide a braking system for lifting devices used for transporting objects upward to tree stands and lowering them down, back to ground level.

Other objects and advantages will be readily apparent from the following detailed description.

DESCRIPTION OF THE PREFERRED EMBODIMENT

Figure 1:
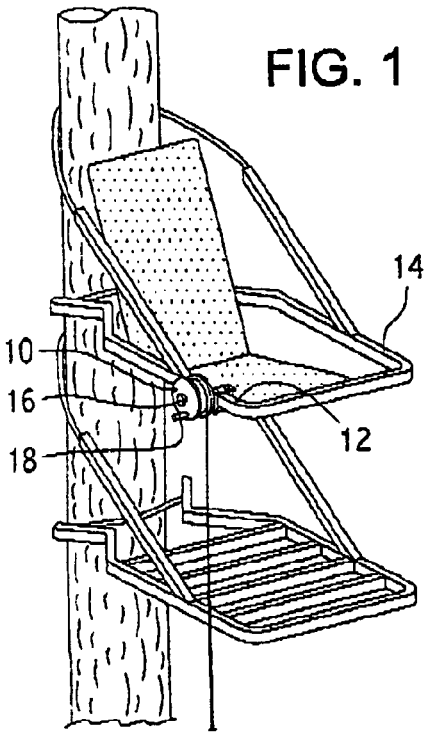
FIG. 1 is a perspective view showing a lifting reel of this invention attached to an upper structural member of a tree stand.

Referring to FIG. 1 of the drawings, there is shown a lifting reel assembly 10 mounted on an upper support member 12 of a tree stand 14, the support member being located in position such that control features of the reel may be readily reached by the occupant of the tree stand, in particular the knob 16 which controls a braking device and a handle 18 used to crank the reel.

Figure 2:
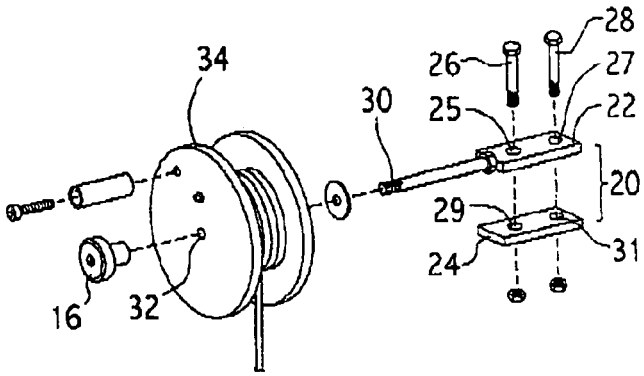
FIG. 2 is an exploded view showing alignment of parts of the reel and clamping brackets.
Figure 3:
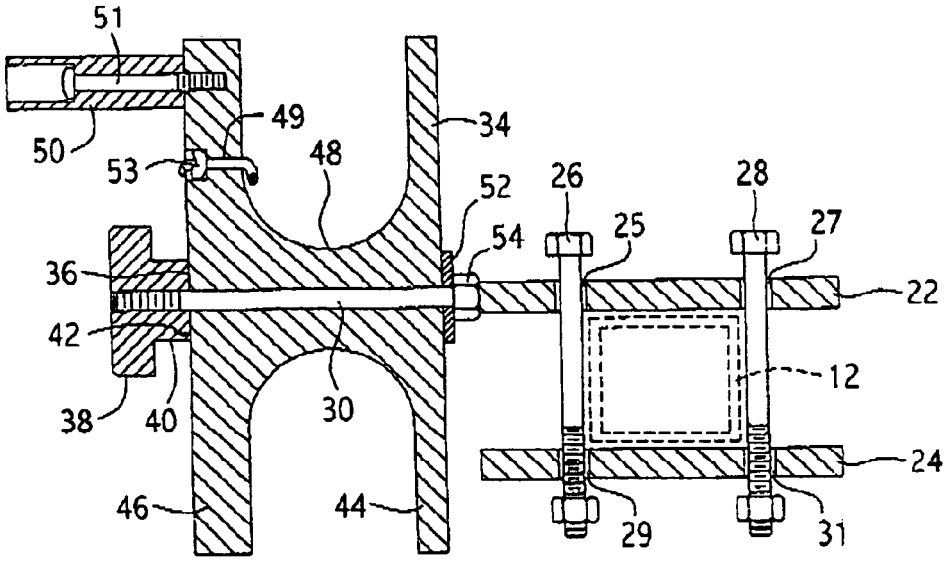
FIG. 3 is a sectional view taken across the center of the reel and attached clamp.

FIG. 2 shows basic components of the reel assembly including a clamp 20 made up of a top mounting bracket 22, a bottom mounting bracket 24 and a pair of bolts 26, 28 extending through holes 25, 27 and 29, 31 which secure the brackets to tree stand support member. Additional holes may be provided at spaced-apart locations to enable connection to larger metal tubing. One of the brackets, which may be the top one 22, is fixedly connected to a central shaft 30 extending through the axis 32 of the reel 34. Shaft 30, which may take the form of a threaded bolt, is held stationary by the mounting bracket and serves as an axle around which the reel rotates, until braking action is applied by means of tightening knob 16 against an outside contact area 36 of reel 34 (FIG. 3).

Knob 16 has a an outer region 38 of a wider diameter such as 1 ½ inch and a thick circular configuration enabling effective grasping when engaging or releasing the contact areas of the knob and reel from engagement. The knob also has an inner region 40 of smaller diameter and less thickness, with the inner surface 42 of this region providing the contacting area for engaging the outer contact area of the reel. This relatively small contact area, which may extend outward to a diameter such as 15/16 inch when engaged, is sufficient to stop the reel from rotating. A flat washer 52 may be inserted between bolt head 54 and the reel 34.

The reel 34 is made up of two circular discs, a thinner disc 44 adjacent to the mounting bracket and a thicker disc 46 connected to the first by a linking bridge 48. Disc 46 is connected on its outer side and near its periphery to a handle 50 by means of which the reel is cranked. The handle is secured to the disc in a manner such that the handle, while allowed to rotate when being cranked, is secured to the disc by means of a "stripper" bolt 51 which provides this result. Disc 46 is also provided with an aperture 49 extending axially across the disc to provide for insertion of an end of the rope or cord 53 to secure it in place.

The disc and bridge portions of the reel, the handle and the knob may all be made of a high-quality plastic material, preferably UHMW (ultra high molecular weight) polyethylene. Round stock of the following sizes may be used for these parts; reel, 4 inch; handle, ⅝ inch and knob, 1 and ½ inch, with excess material being removed by machining or molded in the desired shape.

Shaft 30 is rigidly held at one end by being welded to a clamping bracket 22, and the other end may extend completely or nearly completely through the knob, with male threads of the shaft being engaged with female threads defined in the knob. Force applied to the reel by the contact area of the knob provides effective braking of the reel.

While the clamping brackets are shown as being flat plates, this configuration is intended for use in attaching the reel assembly to a support member of a tree stand where the support member is made of rectangular metal tubing. Where the support member is made of circular metal tubing the clamping brackets may be provided with with a matching shape, which may be provided in the form of arcuate or rounded metal shims inserted between the bars. The cord or rope used in the reel may be comprised of ¼ inch "camo" utility cord, with a length such as 25 feet providing adequate length for the reel disclosed.

While the invention is described in terms of preferred embodiments, it is not to be understood as limited thereto, but is limited only as indicated by the appended claims.

The invention claimed is:

1. A device for lifting and lowering objects by an occupant of a tree stand upward to and downward from a deployed tree stand, said tree stand having a rigid support member within reach of said occupant of the tree stand;

said device comprising a clamp attachable to said support member;

a shaft fixedly attached to said clamp;

a reel rotatably mounted on the shaft, said reel having an outside contacting surface adjacent to said shaft;

a knob mounted on said shaft outside of said reel, said knob having defined therein a central orifice threadably engaging said shaft and including an internal contacting area engageable with said contacting surface of said reel upon rotation of said knob, whereby braking action may be applied to said reel;

a rope or cord installed on said reel and a cranking handle attached to said reel.

2. The device as defined in claim 1 wherein said knob is round and has an inner portion of smaller diameter, said inner portion including a said internal contacting surface defined across an inner surface thereof and said knob having an outer portion of a larger diameter than said inner portion, enabling effective turning of said knob into and out of braking contact with said reel.

3. The device as defined in claim 2 wherein said outer portion of said knob has a diameter of about 1 ½ inch and said inner portion has a diameter of about 15/16 inch.

4. The device as defined in claim 1 wherein said clamp comprises a mating pair of bars engaging a said rigid support member.

5. The device as defined in claim 4 including bolts securing said bars together.

6. The device as defined in claim 1 wherein said reel is made of UHMW polyethylene.

7. The device as defined in claim 1 wherein said rope or cord is ¼ inch camo utility cord.

* * * * *